US005193325A

United States Patent [19]

Allison

[11] Patent Number: 5,193,325

[45] Date of Patent: Mar. 16, 1993

[54] STANDARDIZED PORTABLE HOUSING UNIT

[76] Inventor: Robert S. Allison, 203 B Lentz Rd., Yulee, Fla. 32097

[21] Appl. No.: 799,561

[22] Filed: Nov. 27, 1991

[51] Int. Cl.[5] ..... E04H 5/06

[52] U.S. Cl. ..... 52/745.02; 52/791; 52/799; 52/143; 52/125.6; 52/125.2

[58] Field of Search ..... 52/79.1, 79.2, 79.3, 52/79.9, 143, 125.6, 125.2, 745

[56] References Cited

U.S. PATENT DOCUMENTS 3,792,558 2/1974 Berce et al. ..... 52/79

4,854,094 8/1989 Clark ..... 52/79.1

FOREIGN PATENT DOCUMENTS 2125180 5/1971 Fed. Rep. of Germany ..... 52/79

*Primary Examiner*—Richard E. Chilcot, Jr.
*Assistant Examiner*—Wynn Wood
*Attorney, Agent, or Firm*—Arthur G. Yeager; Earl L. Tyner

[57] ABSTRACT

A housing unit built with load bearing structures (12) at the two ends thereof and including lifting eyes (26) at the corners of the unit such that units can be stacked vertically on each other for transportation.

7 Claims, 3 Drawing Sheets

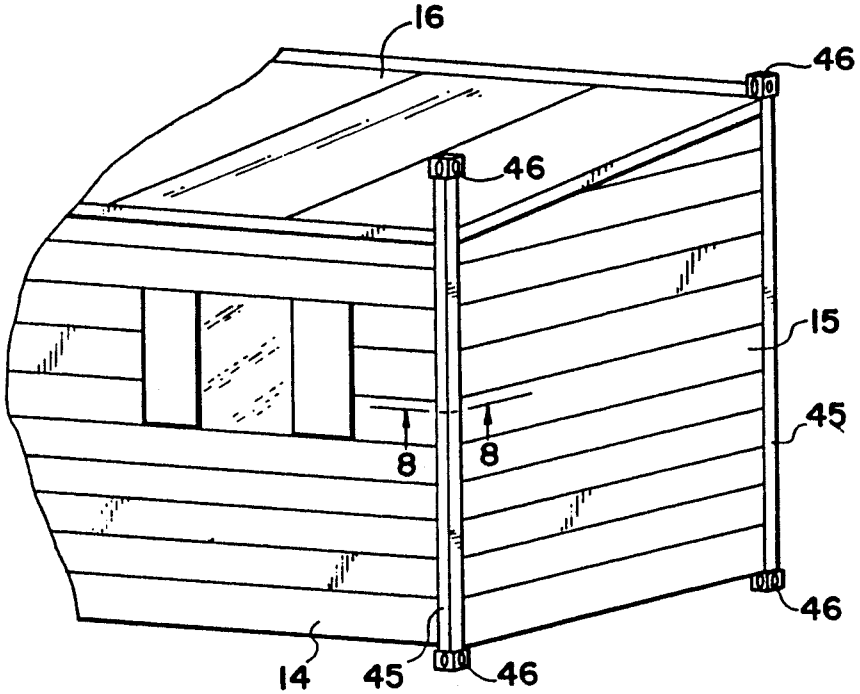
FIG 7
FIG 4
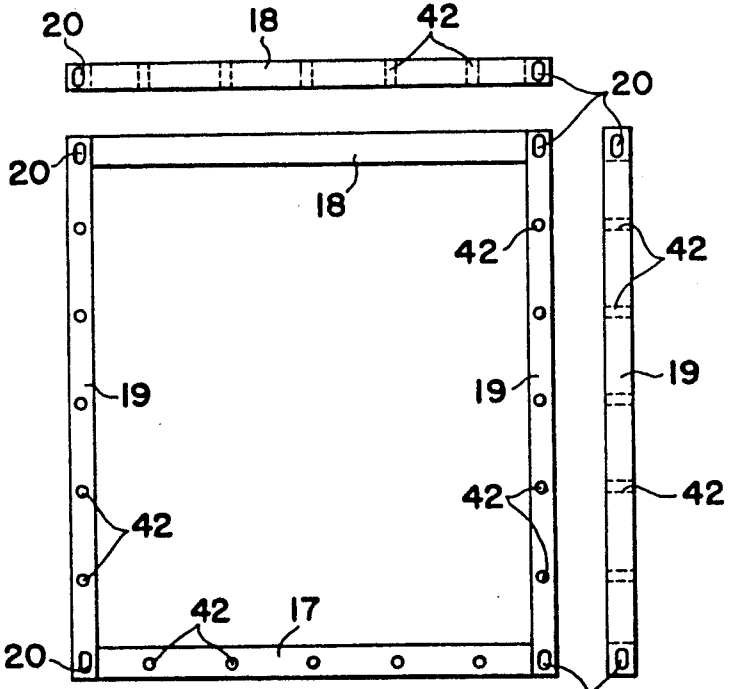
FIG 2
FIG 3

STANDARDIZED PORTABLE HOUSING UNIT

BACKGROUND OF THE INVENTION

Mobile home units are well known in this country and elsewhere in the world. For the most part these units are on a permanently attached frame with wheels and axles and are transported along the highways by being pulled behind a prime mover of some sort, e.g., a truck tractor. In more recent times one or more mobile home units are transported from the manufacturer to a home site where the home units are placed on a suitable foundation. These are not truly mobile homes because they do not have wheels and axles for movement to another location. They are lifted by crane, fork lift trucks, jacks or the like form the ground at the manufacturing location, to a highway truck and from the highway truck to the ground at the eventual home site. Such manufactured housing is capable of being transported by ship but is not capable of being efficiently loaded in stacks as are cargo containers. In my copending patent application Ser. No. 07/799,559 Filed Nov. 27, 1991 there is disclosed a housing unit supported in a frame having a horizontal base and two vertical end structures, the entire structure being transportable.

It is an object of this invention to provide an improved portable housing unit which is capable of shipment as standardized marine cargo. It is another object of this invention to provide a standardized house as a cargo unit that is readily transferred from a ship to a truck for delivery and set-up at a home site. Still other objects will become apparent in the more detailed description which follows.

BRIEF SUMMARY OF THE INVENTION

This invention relates to a transportable enclosed housing unit having a horizontal base support and floor element, two horizontally long front and back vertical walls and two short vertical end walls joined to form four vertical corners and a sloping roof; a rigid vertical beam attached to said housing unit at each corner; said beam having at each end thereof a fitting with a plurality of lifting eyes; all of the fittings defining three pairs of parallel planes which enclose a right prismatic space with every part of the housing unit lying inside the planes.

In different embodiments of the invention the end structures are separate from, or integral parts of, the housing unit.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 2 is a top plan view of the end structure of FIG. 1;

FIG. 3 is a front elevational view of the end structure of FIG. 2;

FIG. 4 is a side elevational view of the end structure of FIGS. 2 and 3;

FIG. 7 is a perspective view of the housing unit of this invention with an individual pole beam attached at each corner;

DETAILED DESCRIPTION OF THE INVENTION

The novel features of this invention are best understood by reference to the attached drawings.

Figure 1:
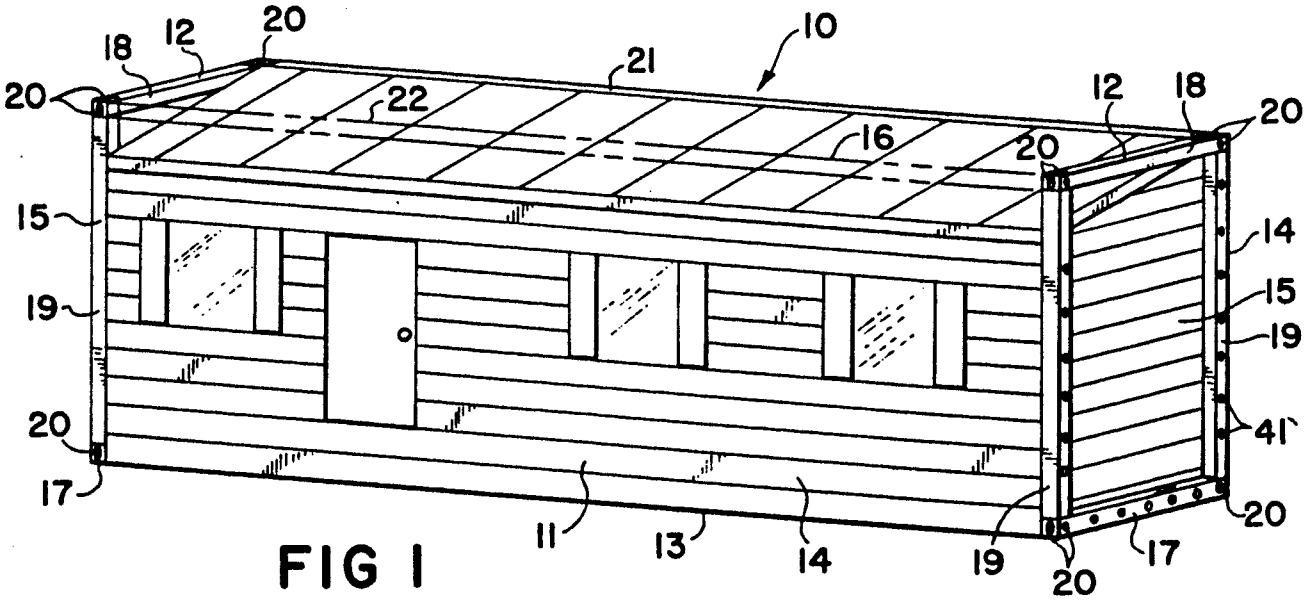
FIG. 1 is a perspective view of the housing unit of this invention with separate rectangular end structures attached to the ends of the housing unit.

In FIG. 1 there is shown a housing structure 10 which, in essence is a housing unit 11 with an end structure 12 attached to each of the ends of the housing unit 11. The housing unit 11 may be a portable home unit (i.e. a mobile home without the wheeled chassis) or other structure for residence, for storage, for office space, or the like, with all interior walls, appliances, etc. installed. This invention does not relate to the housing unit design or its structure except as it is modified by end structures 12 to make it transportable. The requirements that make the housing unit transportable are those of overall dimensions which are specified for cargo units that are transportable by truck, ship, or airplane. In general, the housing unit is transportable by truck, by ship, and even by airplane. The size regulations for ship freight are set forth by the International Standards Organization as ISO 668-1979(E) for freight containers 20 feet, 30 feet, or 40 feet long. The largest size is most suitable for a housing unit and is approximately 40 feet long, 8 feet wide and 9½ feet high. These dimensions feet long are ones which are preferred for the overall dimensions of the housing structure of this invention.

Figure 9:
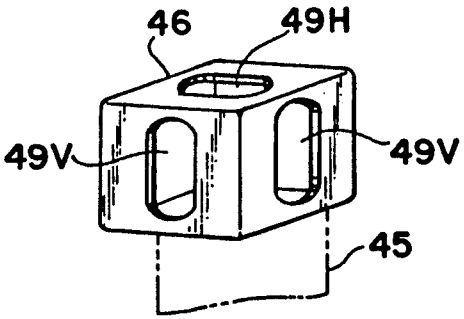
FIG 9 PRIOR ART
FIG. 9 is an enlarged perspective view of an ISO fitting with ovals, for use at the ends of the corner pole structures of FIGS. 1-9.

End structures 12 are rectangular, sufficiently tall vertically to exceed the height of housing unit 11 and sufficiently strong to be supports for another housing structure which may be stacked above. The entire structure of housing unit 11 and two end structures 12 occupy the same prismatic space as a marine cargo container of the standard ISO dimensions. At each of the eight corners of that prismatic space is an arrangement of lifting eyes 20, preferably ISO corner fittings as shown in FIG. 9 having three oval eyes on three contiguous planes of the fitting. These eyes may be machined, torch burned, or otherwise built into the end structures 12. In FIG. 1 end structures 12 are detachably attached to housing unit 11, as by bolting; and in FIG. 5 end structures 25 are built into the housing unit 24.

In the embodiment of FIG. 1 end structures 12 comprise a rectangular arrangement of structural beams, preferably steel or aluminum, but may be wood, plastic, a composite fiberglass, or a combination of such materials. Preferably end structures 12 are welded structures of steel beams, such as I-beams, L-beams, H-beams, channel beams, box beams, or the like. Cross bracing or corner gusset plates are optional additions. The finished structure 12 is shown in FIGS. 2-4 with drilled bolt holes 42 in lower horizontal beam 17 and the two vertical front and back beams 19 to accommodate bolts or lag screens 41 for fastening end structures 12 to the corner studs in house unit 11. It may be necessary to make corner studs larger than is usually the case for a mobile home so as to accommodate bolts or screws 41 while retaining maximum strength in housing unit to resist the stresses of lifting and moving housing unit 11 as it is transported from place to place or stacked.

The four corners of the end structures 12 contain lifting eyes 20 to fit the lifting means available on the transportation system. Preferably these lifting eyes 20 are made to meet ISO specifications (ISO-1161) which are oval eyes that cooperate with oval twist pins that provide quick, secure locking and unlocking by twisting the pin when engaged with the eye. These ISO oval eyes 20 are used in ship lifting operations, in securing the cargo to a truck container chassis trailer, in employing jacks for lifting, and in securing one housing unit 11 to another contiguous housing unit 11.

Figure 5:
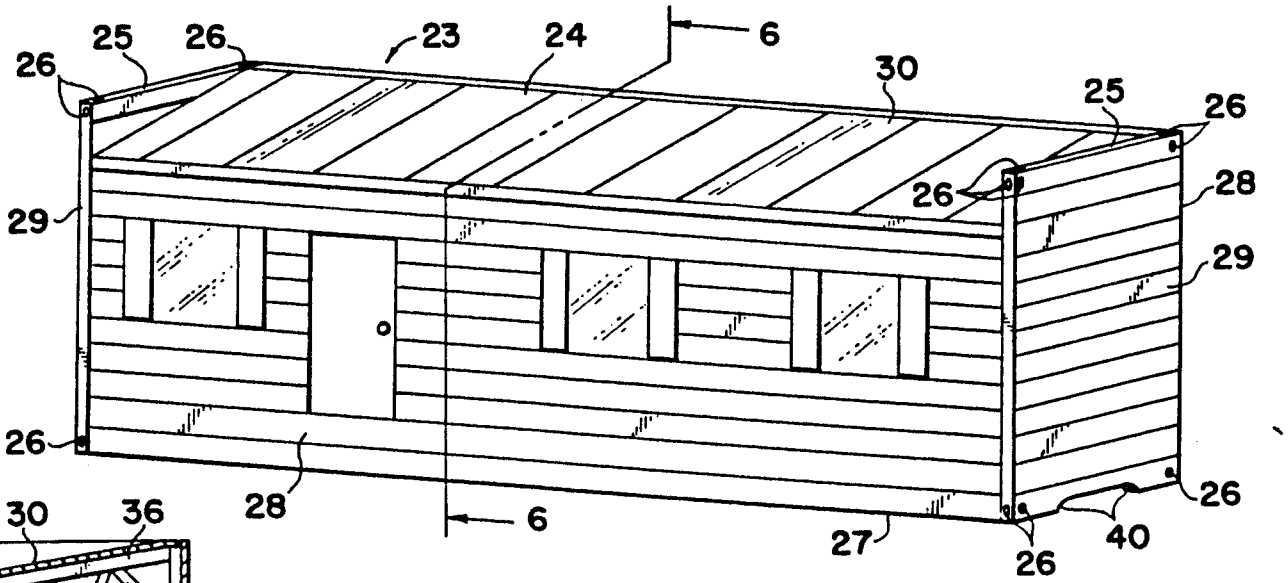
FIG. 5 is a perspective view of a housing unit of this invention with built-in end structure.
Figure 6:
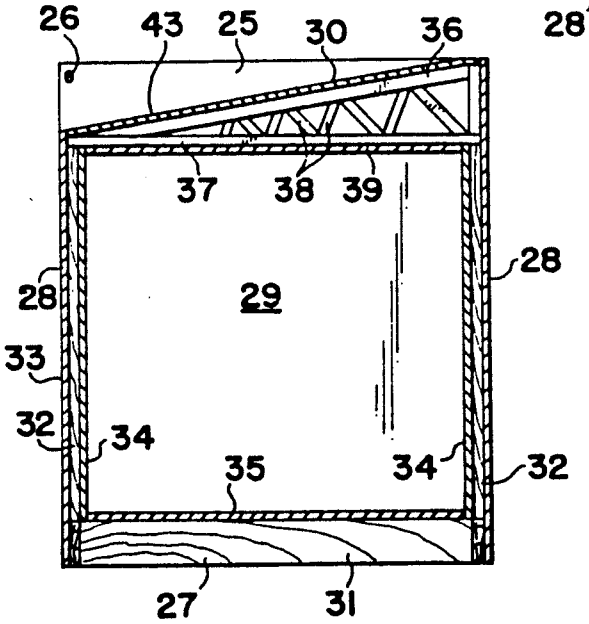
FIG. 6 is a cross sectional view taken at 6—6 of FIG. 5.

In FIGS. 5 and 6 there is shown a housing unit 24 having end structures 25 built into the housing unit 11 such that when completed, the outer dimensions of housing unit 11 and end structures 12 of FIG. 1 are identical to those of housing unit 24 and end structures 25 of FIG. 5. End structures 25 are, as described above for end structures 12, made of structural beams of metal, wood, plastic, composites, or the like. The difference is that end structures 25 are not detachable from housing unit 24 and are therefore shown to be totally enclosed and may be covered by siding like the remainder of the housing unit 24. There must of course be the same arrangement of lifting eyes 26 as in the embodiment of FIG. 1. Housing unit 24 has a bottom and floor member 27, front and back walls 28, end walls 29, sloping roof 30, and is built like any other modular residence as shown in FIG. 6. The housing unit structure of FIG. 6 is descriptive of housing unit 11 as well as housing unit 24. This structure includes floor joists 31, vertical studs 32, outside siding 33, insulation layers (not shown), inside walls 34, flooring 35, rafters 36, ceiling joists 37, reinforcing braces 38, ceiling 39, and roofing 43. In order for a housing unit 24 to be transported level it may be necessary to cut out a portion 40 of end wall 29 and/or end structure 25 because some flat bed trucks have a step in the forward portion of the bed. Another feature that may optionally be included is a port for a lifting jack which may be located adjacent the lower portion of an end wall, e.g., 29. This feature is shown in my copending patent application Ser. No. 07/799,559 filed Nov. 27, 1991. The purpose of such lifting may be to provide space to place a roller under the housing unit so as to roll the unit off the chassis truck trailer at the destination of the housing unit.

End structure 12 as shown in FIGS. 2–4 is particularly important in this invention since it may be used to convert nontransportable construction units like 11, whether or not used for residential purposes, storage purposes, business office purposes, into standardized transportable units. Of course, the unit must be of such dimensions that it will, when modified by end structures 12 be of standardized size for transportation.

Figure 8:
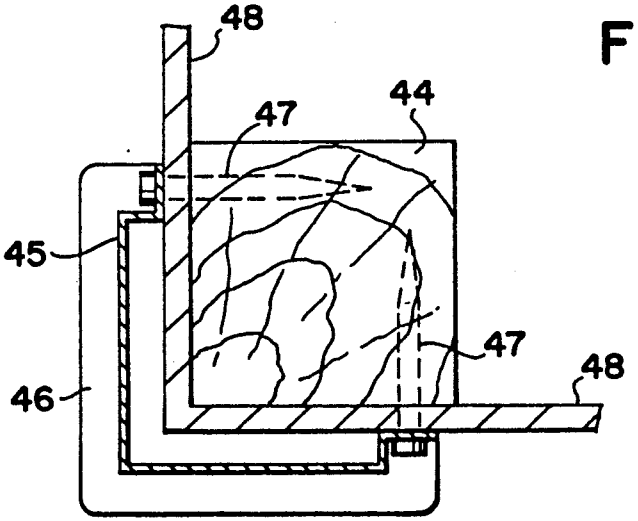
FIG. 8 is a cross sectional view taken at 8—8 of FIG. 7.

In FIGS. 7 and 8 there is shown another embodiment of the housing unit of this invention. In this embodiment four individual vertical beams 45 are employed, one at each vertical corner of the unit. It is not important as to whether the beam 45 is wood, metal, plastic, or a combination of two or more components so long as the beam is rigid and capable of being a load supporting structure, e.g., capable of supporting at least one-quarter of the weight of the housing unit. A typical structure is shown in FIG. 8 wherein a corner stud 44 (one 4×4 or two 2×4's) is combined with a steel L-beam structure 45 by a plurality of lag bolts 47. Siding panels 48 are attached to vertical studs by nailing, bolting, or gluing. At each end (upper and lower) of beam 45 is a fitting 46 meeting ISO standards, and having the general characteristics shown in FIG. 9. On three adjoining faces of fitting 46 are oval eyes 49H (horizontal top or bottom face) and 49V (vertical faces at front, back, or end). Fitting 46 is preferably welded to the ends of steel L-beam 45. The positioning of fittings 46 and corner beams 45 is critical in that the faces of all eight fittings 46 define three pairs of parallel planes intersecting with each other to form an enclosed right prismatic space (or a parallelopipedic space) which includes all parts of the housing unit inside of those intersecting planes. By appropriate bolting and clamping between adjacent fittings 46, two or more housing units may be stacked on top of each other for transportation. In such stacking, only fittings 46 of adjoining housing units touch each other.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to be secured by Letters Patent of the United States is:

1. A method for transforming a prefabricated housing unit having four vertical corners into a standardized transportable stackable housing unit which comprises attaching to each said corner of the prefabricated housing unit a, weight-supporting rigid beam having a plurality of lifting eyes at each end of said beam and being positioned such that the beam ends adjacent said eyes lie in three pairs of parallel planes defining a prismatic space which completely encloses said standardized housing unit and has outside dimensions identical to those of standard cargo containers.

2. The method of claim 1 wherein two of said beams are joined together into a single rigid structure attachable to the end of said housing unit.

3. The method of claim 2 wherein said two beams are joined by two spaced horizontal beams to form a rectangular structure.

4. The method of claim 1 wherein said dimensions of standard cargo containers are 8 feet wide, 20–40 feet long and 8–9½ feet high.

5. The method of claim 1 wherein said standard cargo containers are 8 feet wide, 20–40 feet long and 8–9½ feet high.

6. The method of claim 1 wherein said rigid beam is detachable from said housing unit.

7. The method of claim 1 wherein each said beam end has three lifting eyes, one eye in each said plane that intersects at said beam end.

* * * * *